US008576132B2

(12) United States Patent
Lier

(10) Patent No.: US 8,576,132 B2
(45) Date of Patent: Nov. 5, 2013

(54) METAMATERIAL LENS FEED FOR MULTIPLE BEAM ANTENNAS

(75) Inventor: Eric Lier, Newtown, PA (US)

(73) Assignee: Lockheed Martin Corporation, Bethesda, MA (US)

( * ) Notice: Subject to any disclaimer, the term of this patent is extended or adjusted under 35 U.S.C. 154(b) by 383 days.

(21) Appl. No.: 12/908,068

(22) Filed: Oct. 20, 2010

(65) Prior Publication Data

US 2011/0095953 A1 Apr. 28, 2011

Related U.S. Application Data

(60) Provisional application No. 61/254,167, filed on Oct. 22, 2009.

(51) Int. Cl.
*H01Q 19/10* (2006.01)

(52) U.S. Cl.
USPC ..... 343/755; 343/781 P; 343/781 R

(58) Field of Classification Search
USPC ..... 343/75, 755, 781 R, 781 CA, 781 P, 840, 343/753
See application file for complete search history.

(56) References Cited

U.S. PATENT DOCUMENTS

| | | | | |
|---|---|---|---|---|
| 3,914,768 | A | 10/1975 | Ohm | |
| 5,206,658 | A | 4/1993 | Wokurka | |
| 7,522,116 | B2 | 4/2009 | Balling et al. | |
| 2006/0092087 | A1* | 5/2006 | Lange | 343/782 |
| 2007/0285315 | A1* | 12/2007 | Davis et al. | 342/377 |
| 2008/0165079 | A1 | 7/2008 | Smith et al. | |
| 2009/0213022 | A1 | 8/2009 | Lier et al. | |
| 2009/0218524 | A1 | 9/2009 | Kare | |
| 2009/0251362 | A1 | 10/2009 | Margomenos et al. | |
| 2010/0027130 | A1* | 2/2010 | Bowers et al. | 359/642 |
| 2010/0033389 | A1 | 2/2010 | Yonak et al. | |
| 2010/0207012 | A1* | 8/2010 | Hyde et al. | 250/208.2 |

FOREIGN PATENT DOCUMENTS

WO 2006023195 A2 3/2006

OTHER PUBLICATIONS

Mukoh, Y. et al.; "A Reflector Lens Antenna Consisting of an Artificial Dielectric"; Electronics & Communications in Japan, Part I—Communications, Wiley, Hoboken, NJ, US; vol. 82, No. 7, Jul. 1, 1999, pp. 44-51, XP000823946, ISSN: 8756-6621.

* cited by examiner

*Primary Examiner* — Hoanganh Le
(74) *Attorney, Agent, or Firm* — Fraser Clemens Martin & Miller LLC; J. Douglas Miller

(57) ABSTRACT

A multiple beam reflector antenna includes at least one reflector, a plurality of feed horns for feeding the at least one reflector, and a metamaterial lens interposed between the plurality of feed horns and the at least one reflector. The metamaterial lens may provide an overlapping element distribution from at least two feed horns of the plurality of feed horns. In one embodiment, the metamaterial lens has an index of refraction between about zero and about one.

15 Claims, 5 Drawing Sheets

METAMATERIAL LENS FEED FOR MULTIPLE BEAM ANTENNAS

CROSS-REFERENCE TO RELATED APPLICATIONS

The present application claims priority to U.S. Provisional Application Ser. No. 61/254,167 filed Oct. 22, 2009, incorporated by reference herein in its entirety.

STATEMENT REGARDING GOVERNMENT SPONSORED RESEARCH OR DEVELOPMENT

Not Applicable.

FIELD OF THE INVENTION

The present invention relates antenna systems. In particular, the present disclosure relates to multibeam reflector antenna systems for use in satellite communication systems.

BACKGROUND OF THE INVENTION

Over the last few years, there has been a tremendous growth in the use of multiple-beam antenna (MBA) systems for satellite communications. For example, MBAs are currently being used for direct-broadcast satellites (DBS), personal communication satellites (PCS), military communication satellites, and high-speed Internet applications. These antennas provide mostly contiguous coverage over a specified field of view on Earth by using high-gain multiple spot beams for downlink (satellite-to-ground) and uplink (ground-to-satellite) coverage.

It is known to provide MBA systems having multiple reflectors, each of which supports both transmission and reception of signals. Such systems require a plurality of feed horns for feeding each of the reflectors. The feed horns are designed for providing signal transmission and reception over widely separated respective transmission and reception frequency bands.

For each individual reflector, feed horn efficiency and directivity limits the effectiveness of the antenna system. In particular, an inadequately directive feed horn causes an energy spill over the reflector that can account for up to a 3 dB gain loss, and can also affect pattern performance on the ground.

As shown in FIG. 1, a conflicting set of requirements governs the design of known MBA reflector systems 10. Feed horns 12A, 12B, 12C, 12D feed respective signal beams 14A, 14B, 14C, 14D to the reflector 16. The size of each feed horn 12A, 12B, 12C, 12D limits the angular spacing 13 between each of the respective signal beams 14A, 14B, 14C, 14D. A larger horn 12A, 12B, 12C, 12D having a larger horn aperture improves the efficiency of the MBA reflector system 10 for a given reflector size by decreasing the spillover loss and by increasing the Equivalent Isotropically Radiated Power, or EIRP for transmit satellite antennas (a measurement of power density on the ground), and increases the gain over temperature, or G/T for receive satellite antennas. However, the larger horn 12A, 12B, 12C, 12D having an increased horn aperture also increases the angle β between the respective signal beams 14A, 14B, 14C, 14D, resulting in widely spaced spot beams 18A, 18B, 18C, 18D that produce coverage over a small portion of the overall coverage area. Coverage of any spaces between the widely spaced beams 18A, 18B, 18C, 18D requires the use of additional reflectors 16 to achieve an interleaved beam layout on the ground, increasing cost, complexity and payload requirements of the system.

Typically, gain enhancement from multiple beam reflector antennas can be achieved by increasing the horn gain, reflector shaping, creating an overlapping subarray using a plurality of horns combined via a complex beamforming network, or increasing the number of reflector antennas, sometimes as much as quadruple the number of reflectors.

Gain enhancement lenses are beginning to be used to enhance feed horn gain by improving the effective feed horn aperture. For example, Luneberg lenses having graded indices of refraction using a regular dielectric are well known, but are typically large, heavy, and have a high cost, and are therefore impractical for space applications. Additionally, an elemental gain enhancement lens has been demonstrated based on a thin electromagnetic band gap (EBG) lens. The EBG lens is known to reduce cross-polarization and increases the gain of a small aperture horn antenna array feed system to produce a system of overlapping beams. However, the EBG lens has been demonstrated only over a very narrow (1%-2%) bandwidth. Widely separated simultaneous transmit and receive bands, such as 12/17 GHz or 20/30 GHz bands, are not supported by the EBG lens. Recently, an active lens design having amplifiers inside the lens has been proposed for transmit MBAs. The active lens design concept accepts a high feed-lens spillover loss since this it occurs on the low power side of the high power amplifiers. However, the active lens design concept is in a preliminary stage, and in any event, is only applicable to transmit MBAs.

There is therefore a need for a multi-beam, multi-band antenna with closely spaced antenna feed horns having an increased effective feed horn aperture and a reduced spill over loss that is also capable of simultaneous operation over widely separated transmit and receive bands.

SUMMARY OF THE INVENTION

Concordant and consistent with the present invention, a multiple beam reflector antenna that provides an increased effective feed horn aperture and a reduced spill over loss capable of simultaneous operation over widely separated transmit and receive bands has surprisingly been discovered. The multiple beam reflector antenna includes at least one reflector, a plurality of feed horns for feeding the at least one reflector, and a metamaterial lens interposed between the plurality of feed horns and the at least one reflector. The metamaterial lens provides an overlapping element distribution from at least two feed horns of the plurality of feed horns. In one embodiment, the metamaterial lens has an index of refraction between about zero and about one. In another embodiment, the metamaterial lens is comprised of one or more of low index materials (LIM), zero index materials (ZIM), and graded index (GRIN) materials that may have an index of refraction below one or above one.

In another embodiment, a lower surface of the metamaterial lens is adjacent the feed horn apertures of at least two adjacent feed horns. The lower surface of the metamaterial lens includes a notch disposed between the at least two adjacent feed horns to provide separation between the feed horn apertures of the at least two adjacent feed horns to reduce mutual coupling of feed signals therefrom.

In another embodiment, a multiple beam reflector antenna includes at least one reflector and a plurality of feed horns for feeding the at least one reflector. Each feed horn in the plurality of feed horns includes a throat section that terminates in a substantially conical section, the substantially conical section flaring outwardly from the throat section and terminating in a feed horn aperture. A metamaterial lens is interposed between at least one feed horn aperture of the plurality of feed horns and the at least one reflector. The metamaterial lens may provide an overlapping element distribution from at least two feed horns of the plurality of feed horns.

BRIEF DESCRIPTION OF THE DRAWINGS

The above, as well as other advantages of the present disclosure, will become readily apparent to those skilled in the art from the following detailed description of the preferred embodiment when considered in the light of the accompanying drawings, in which.

DETAILED DESCRIPTION OF EXEMPLARY EMBODIMENTS OF THE INVENTION

The following detailed description and the appended drawing describe and illustrate various embodiments of the invention. The description and drawings serve to enable one skilled in the art to make and use the invention, and are not intended to limit the scope of the invention in any manner.

Figure 2:
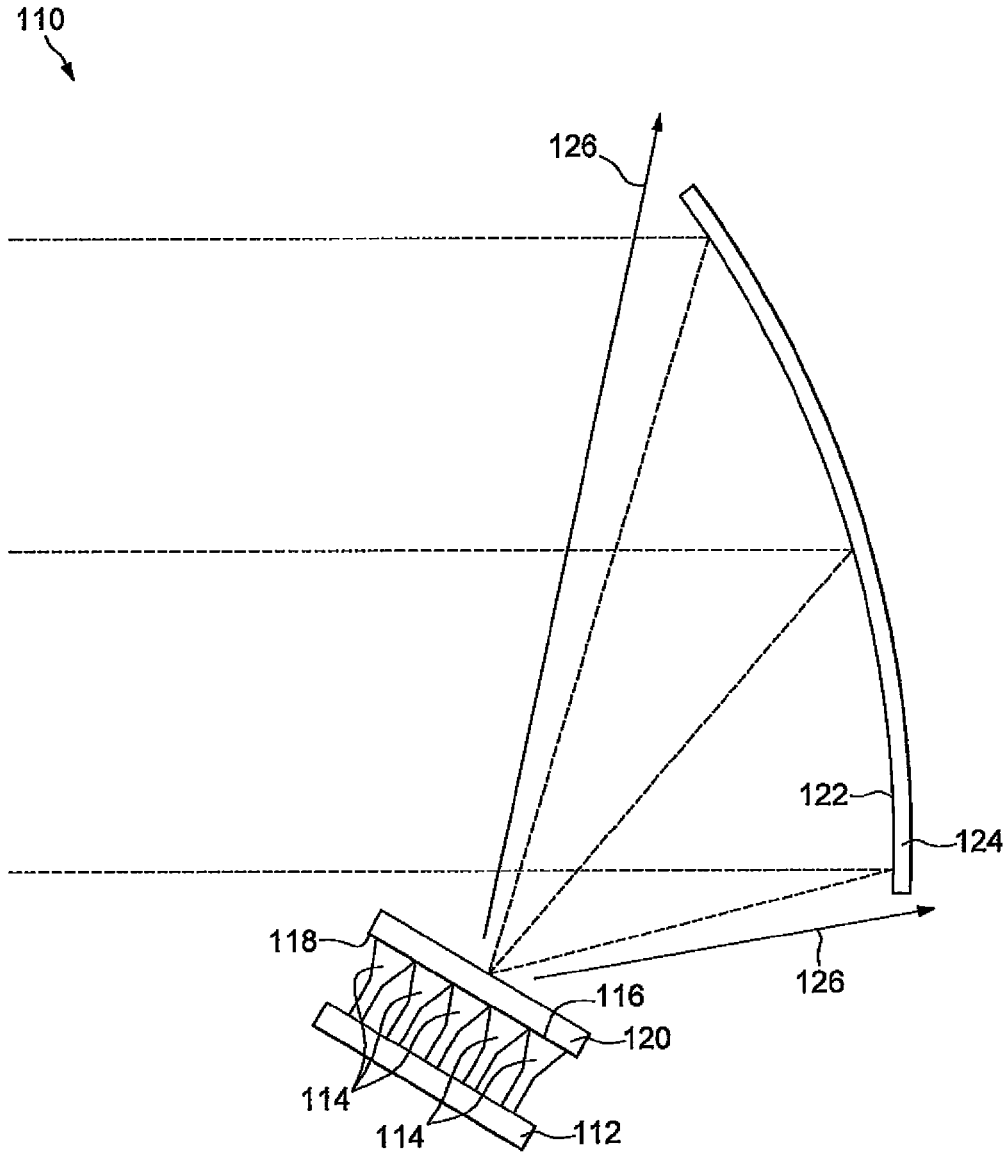
FIG. 2 is diagrammatic view of an MBA reflector system showing spill over loss according to an embodiment of the present disclosure.

A multiple beam antenna (MBA) reflector system 110 constructed according to the present invention is shown in FIG. 2. A signal feed network 112 includes a plurality of feed horns 114 that each terminate in a feed horn aperture 116. It is understood that each feed horn 114 may be individually optimized for frequency and power as is known in the art, and may be configured for transmission or for reception of signals within a desired frequency band, or for both. It is further understood that the feed horns 114 may generate different or identical waveforms, as desired. Each feed horn aperture 116 abuts a lower surface 118 of a metamaterial lens 120, embodiments of which are further described hereinbelow.

In a transmission mode, for example, the output signal of the feed horns 114 passes through the metamaterial lens 120 and is incident upon a reflective surface 122 of a reflector 124. The reflective surface 122 may have any desired shape, such as parabolic or elliptical for example, or other design attributes, such as a reflector diameter, focal length, or the like, and operates to reflect the output signal of the feed horns 114 to a desired reception area (not shown). A portion of the output signal 126 of the feed horns 114 misses the reflector 124 entirely and is considered spill over loss. According to the present disclosure, the metamaterial lens 120 is designed to minimize the spill over loss portion of the output signal 126 while maximizing the portion of the output signal 126 of the feed horns 114 that is incident upon the reflective surface 122.

Figures 3A, 3B:
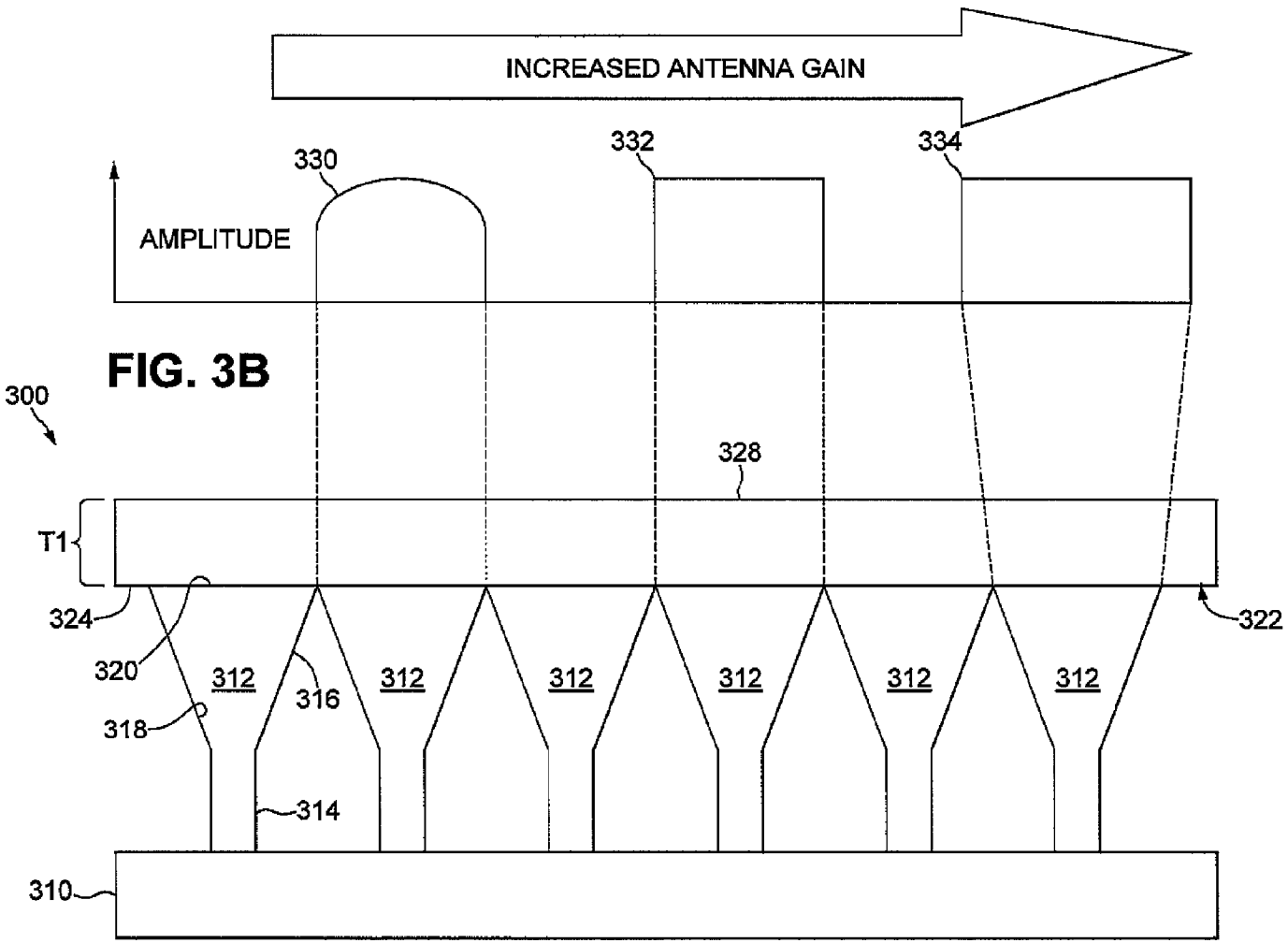
FIG. 3A is a diagrammatic view of an MBA feed system including a metamaterial lens formed according to an embodiment of the present disclosure.
FIG. 3B is a graphical representation of various waveforms produced by the metamaterial lens of FIG. 3A.

One embodiment of a feed system 300 is shown in FIG. 3A. The feed system 300 includes a feed network 310 that forms and feeds signals to a plurality of feed horns 312. The plurality of feed horns 312 may be identical, or the plurality of feed horns 312 may be individually optimized, as desired, and may have any known configuration. For example, the feed horns 312 shown in FIG. 3A each comprise a throat section 314 that terminates in a substantially conical section 316 that flares outwardly from the throat section 314. The substantially conical section 316 has an inner surface 318 that may include a variable slope. Each substantially conical section 316 terminates in a horn aperture 320.

According to the present disclosure, a metamaterial lens 322 is interposed between the feed horns 312 and a reflector surface (not shown). In one embodiment, the feed horn aperture 320 is placed adjacent a lower surface 324 of the metamaterial lens 322 to allow the output signal emitted by the feed horn 312 to be focused by the metamaterial lens 322 by creating a uniform phase front over the lens aperture along a top surface of the metamaterial lens 328. As the output signal passes through the metamaterial lens 322, the output signal is optically adjusted by the metamaterial lens 322 to become a highly collimated narrow beam output signal. The optical adjustment of the output signal by the metamaterial lens 322 increases the effective aperture of each of the feed horns 312, thereby increasing the feed horn gain.

The metamaterial lens 322 may be formed using known transformation optical lens design methods using materials known to demonstrate a low index of refraction n, defined as:

$$n=\sqrt{\epsilon_r\mu_r} \qquad \text{Equation 1}$$

where $\epsilon_r$ is the relative permittivity and $\mu_r$ is the relative permeability. In low index materials (LIM) lens designs, the index of refraction n of the material is in the range of zero to one ($0<n<1$). In one embodiment, the index of refraction n of the material used to form the metamaterial lens may be designed in three dimensions to have a varying or graded index of refraction over the entire volume of the metamaterial lens 322. The graded index (GRIN) lens may be used to optimize the output of each individual feed horn 312 to produce a highly collimated output beam from each horn for incidence upon the reflector surface (not shown). In particular, the transformation optical lens design is able to spread or fan the electromagnetic energy received by the lower surface 324 of the metamaterial lens 322 through the thickness T1 of the metamaterial lens 322 so that the electromagnetic energy at the top surface 328 of the metamaterial lens is spread over a larger area than the horn aperture it originates from and includes a substantially uniform phase distribution. The metamaterial lens 322 may spread the electromagnetic energy sufficiently to achieve an overlapping beam from adjacent feed horns 312, where the overlapping beams demonstrate an effective feed horn aperture greater than the physical envelope of the actual feed horn apertures 320. Transformation optics may also be utilized to create a three-dimensional design of the metamaterial lens 322 that may include a combination of one or more of zero index materials (ZIM), low index materials (LIM), and graded index (GRIN) materials that could have an index of refraction below one or above one. Favorable results have been achieved where a thickness T1 of the metamaterial lens 322 is less than one wavelength of the output signal frequency, and in particular, where the thickness T1 of the metamaterial lens less than about one-half of one wavelength of the output signal frequency. Thus, optimization of the GRIN lens may additionally require a varying thickness T1 depending upon the frequency of the output signal of any feed horn 312.

As shown in FIG. 3B, the metamaterial lens 322 of FIG. 3A may be optimized to produce varying improvements in feed horn gain. For example, a first aperture distribution 330 shows a realistic horn aperture distribution that reasonably may be achieved in the absence of the metamaterial lens 322. While the first aperture distribution 330 may include a signal having uniform phase, the amplitude or power of the first aperture distribution varies over the width of the feed horn aperture. The metamaterial lens 322 may be optimized to increase the amplitude of the uniform phase signal to achieve the uniform amplitude signal profile of the second aperture distribution 332. The second aperture distribution 332 demonstrates an increased feed horn gain over the first aperture distribution 330 due to a uniform amplitude signal that results in a more directive feed output. However, the LIM or GRIN lens may also be utilized to effectively expand the feed horn aperture beyond the physical envelope of the feed horn 312 to broaden the aperture distribution as shown in the third aperture distribution 334. If properly implemented, the third aperture distribution 334 produces highly directive and overlapped output signals from adjacent feed horn apertures, and increases the effective feed horn gain. The highly directional and collimated nature of the third aperture distribution 334 also reduces spill over loss from the feed horns and maximizes an Equivalent Isotropically Radiated Power (EIRP). The ability to increase the effective feed horn aperture beyond the physical envelope of the feed horn 312 allows utilization of smaller feed horns to achieve favorable aperture distributions, as discussed hereinbelow with reference to FIG. 5.

The metamaterial lens 322 may further be optimized to achieve a wave impedance match at the interface between air and a surface of the metamaterial lens. In particular, optimization of the metamaterial lens 322 may achieve an impedance match at the interface between the lower surface 324 of the metamaterial lens 322 and the feed horn aperture 320, and at the interface between the top surface 328 of the metamaterial lens 322 and the air. The wave impedance Z at any point of the metamaterial lens is defined as:

$$Z=\sqrt{\in/\mu} \qquad \text{Equation 2}$$

where $\in$ is the electric permittivity and $\mu$ is the magnetic permeability of the material through which the wave is traveling. In one embodiment, the lower surface 324 and at the top surface 328 of the metamaterial lens 322 are designed so that $\in$ and $\mu$ are substantially equal, so that the wave impedance at the lower surface 324 and at the top surface 328 of the metamaterial lens 322 is substantially equal to the wave impedance of free space.

Figures 4A, 4B:
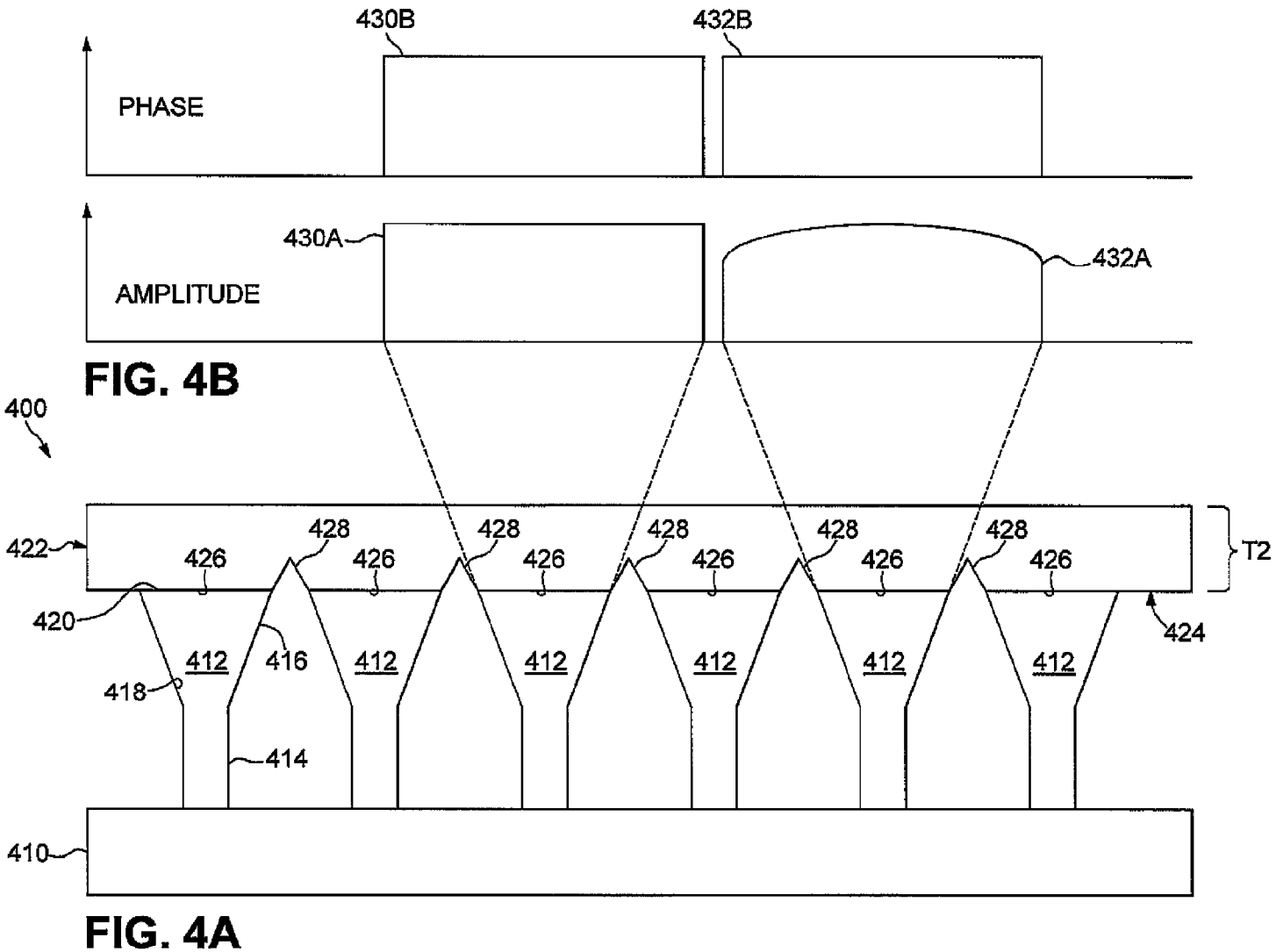
FIG. 4A is a diagrammatic view of an MBA feed system including a metamaterial lens formed according to another embodiment of the present disclosure.
FIG. 4B is a graphical representation of various waveforms produced by the metamaterial lens of FIG. 4A.

Another embodiment of a feed system 400 according to the present disclosure is shown in FIG. 4A. The feed system 400 includes a feed network 410 that forms and feeds signals to a plurality of feed horns 412. The plurality of feed horns 412 may be identical, or the plurality of feed horns 412 may be individually optimized, as desired, and may have any known configuration. For example, the feed horns 412 shown in FIG. 4A each include a throat section 414 that terminates in a substantially conical section 416 that flares outwardly from the throat section 414. The substantially conical section 416 has an inner surface 418 that may include a variable slope. Each substantially conical section 416 terminates in a horn aperture 420.

According to the embodiment, a metamaterial lens 422 is interposed between the feed horns 412 and a reflector surface (not shown). In one embodiment, the feed horn aperture 420 is placed adjacent a lower surface 424 of the metamaterial lens 422 to allow the output signal emitted by the feed horn 412 to be focused by the metamaterial lens 422. An output signal emanating from each feed horn aperture 420 is coupled to the metamaterial lens 420 through a substantially flat lower surface portion 426 of the lower surface 424 of the metamaterial lens 422. Each substantially flat lower surface portion 426 of the metamaterial lens 422 is separated from the other substantially flat lower surface portions 426 by a notch 428 disposed therebetween.

As the output signal passes through the metamaterial lens 422, the output signal is optically adjusted by the metamaterial lens 422 to become a highly collimated narrow beam output signal. The optical adjustment of the output signal by the metamaterial lens 422 increases the effective aperture of each of the feed horns 412, thereby increasing the feed horn gain. The notch 428 provides separation between each adjacent feed horn aperture 420 to reduce mutual coupling of feed signals from adjacent feed horns 412.

The metamaterial lens 422 may be formed using known transformation optical lens design methods using materials known to demonstrate a low index of refraction n defined hereinabove in Equation 1. In low index materials (LIM) lens designs, the index of refraction n of the material is in the range of zero to one ($0<n<1$). In one embodiment, the index of refraction n of the material used to form the metamaterial lens may be designed in three dimensions to have a varying or graded index of refraction over the entire volume of the metamaterial lens 422. The graded index (GRIN) lens may be used to optimize the output of each individual feed horn 412 to produce a highly directive and collimated output beam from each horn for incidence upon the reflector surface (not shown). In particular, the transformation optical lens design is able to spread or fan the electromagnetic energy received by the lower surface 424 of the metamaterial lens 422 through the thickness T2 of the metamaterial lens 422 so that the electromagnetic energy at the top surface of the metamaterial lens includes a substantially uniform phase distribution. The metamaterial lens 422 may spread the electromagnetic energy sufficiently to achieve an overlapping beam from adjacent feed horns 412, where the overlapping beams demonstrate an effective feed horn aperture greater than the physical envelope of the actual feed horn apertures 420. Transformation optics may also be utilized to create a three-dimensional design of the metamaterial lens 422 that may include a combination of one or more of zero index materials (ZIM), low index materials (LIM), and graded index (GRIN) materials that could have an index of refraction below one or above one. A three-dimensional design of the metamaterial lens 422 may include a combination of one or more of zero index materials (ZIM), low index materials (LIM), and graded index (GRIN) materials. Favorable results have been achieved where a thickness T2 of the metamaterial lens 422 is less than one wavelength of the output signal frequency, and in particular, where the thickness T2 of the metamaterial lens less than about one-half of one wavelength of the output signal frequency. Thus, optimization of the GRIN lens may additionally require a varying thickness T2 depending upon the frequency of the output signal of any feed horn 412.

The metamaterial lens 422 may further be optimized in three dimensions to achieve a wave impedance match at the interface between air and a surface of the metamaterial lens. In particular, optimization of the metamaterial lens 422 may achieve a wave impedance match at the interface between the lower surface 424 of the metamaterial lens 422 and the feed horn aperture 420, and at the interface between the top surface 428 of the metamaterial lens 422 and the air. Wave impedance is defined with reference to Equation 2 hereinabove. In one embodiment, the lower surface 424 and at the top surface 428 of the metamaterial lens 422 are designed so that $\in$ and $\mu$ are substantially equal, so that the wave impedance at the lower surface 424 and at the top surface 428 of the metamaterial lens 422 is substantially equal to the wave impedance of free space.

As shown in FIG. 4B, the metamaterial lens 422 of FIG. 4A may be optimized to produce significant improvements in feed horn gain. In particular, the metamaterial lens 422 of FIG. 4A is optimized to increase the effective feed horn aperture beyond the physical envelop of the feed horn 412 while also improving both amplitude and phase characteristics of the signal. The lower aperture distribution graphs of FIG. 4B show optimization of the effective feed horn aperture for signal amplitude, while the upper aperture distribution graphs of FIG. 4B show optimization of the effective feed horn aperture for signal phase. The leftmost aperture distribution 430A optimized for signal amplitude in FIG. 4B shows that the metamaterial lens 422 may be optimized for a substantially uniform amplitude. The feed signal may also be optically adjusted by the metamaterial lens 422 to have a substantially uniform phase, as shown in the leftmost aperture distribution 430B optimized for phase in FIG. 4B. In combination, the optimized substantially uniform amplitude signal 430A and the optimized substantially uniform phase signals 430B provide increased feed horn gain, and the directional and collimated nature of the signals 430A, 430B reduce the spillover loss of the antenna system.

The metamaterial lens 422 may be adjusted to improve the power gain and directivity of the feed signals, as demonstrated by the aperture distributions 432A and 432B of FIG. 4B. The aperture distribution 432A displays a non-uniform or tapered amplitude, maximized at the center of the distribution 432A, while the signal phase remains uniform, as shown by aperture distribution 432B. Because the amplitude distribution is tapered, the radiation pattern from that aperture has lower sidelobes when compared to the uniform aperture distribution 430A, thereby minimizing spill over loss across the reflector. Thus, the metamaterial lens 422 may be designed and implemented to provide a fully optimized feed signal.

Figure 1:
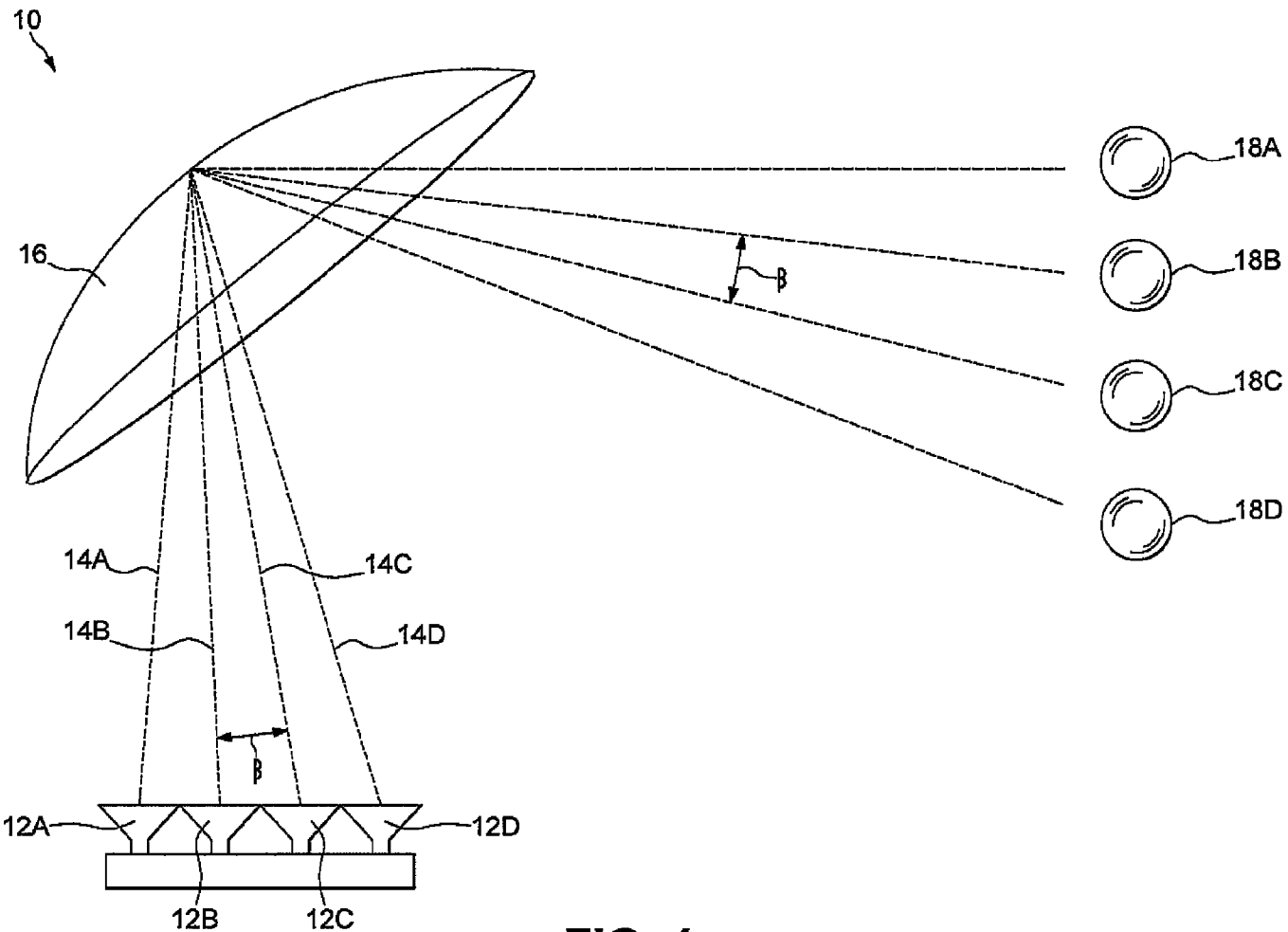
FIG. 1 (PRIOR ART)
FIG. 1 is a diagrammatic view of a prior art MBA feed system capable of limited ground spot coverage.
Figure 5:
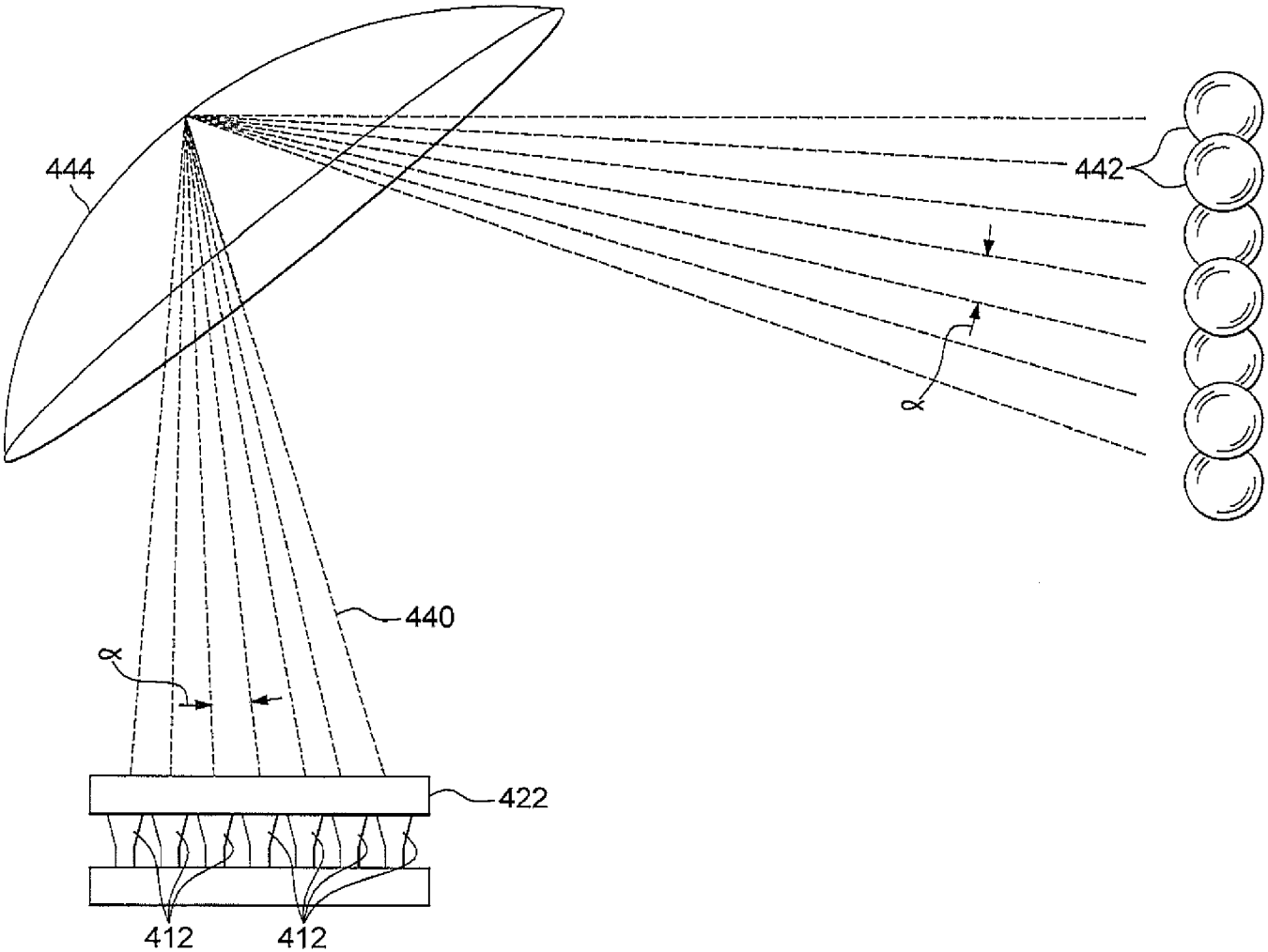
FIG. 5 is a diagrammatic view of an MBA reflector system according to the present disclosure demonstrating interleaved ground spot coverage.

Additionally, due to the design of the metamaterial lens 422, the output feed signals from adjacent fed horns 412 may overlap, resulting in an overlapping element distribution of feed signals, providing the ability to increase the number of feed signals per reflector. As noted hereinabove, the metamaterial lens 422 optically enhances the output signal from the feed horn aperture 420 so that the effective feed horn aperture is larger than the physical envelope of the feed horn 412. Thus, the size of each feed horn 412 may be reduced while still realizing high signal gain with acceptable spillover loss, and further obtaining overlapping signal coverage. Reducing the size of each feed horn 412 is further advantageous, as shown in FIG. 5. By reducing the size of each feed horn 412, a larger number of feed horns 412 may be fit into the space occupied by the feed horns 12A, 12B, 12C, 12D of FIG. 1, resulting in a greater number of overlapping signal beams 440 separated by an angle $\alpha$ that is smaller than the angle $\beta$ for multiple beam reflector antenna systems having the same reflector diameter and focal length, antenna gain and beam size. More overlapping signal beams 440 from the same space further results in more and overlapping signal beams 440 incident upon the reflector 444, and more and overlapping spot beams 442 on the ground, providing more signal coverage. Favorable results have been obtained when the feed horns 412 are half the size of the feed horns 12 or smaller, resulting in an angle $\alpha$ that is half of the angle $\beta$ or smaller, and resulting in at least twice the number of spot beams 442 than spot beams 18 from the same package size in a one-dimensional array, and resulting in at least four times the number of spot beams 442 than spot beams 18 from the same package size in a two-dimensional array. Thus, a multiple beam reflector antenna utilizing the metamaterial lens of the present disclosure minimizes the number of reflector antennas required for ground coverage, which further results in significant reductions in mass, cost, and complexity of the reflector antenna systems.

While certain representative embodiments and details have been shown for purposes of illustrating the invention, it will be apparent to those skilled in the art that various changes may be made without departing from the scope of the disclosure, which is further described in the following appended claims.

What is claimed is:

1. A multiple beam reflector antenna, comprising:

at least one reflector, a plurality of feed horns feeding the at least one reflector, each feed horn of the plurality of feed horns terminating in a feed horn aperture; and a metamaterial lens interposed between the plurality of feed horns and the at least one reflector, wherein the metamaterial lens provides an overlapping element distribution from at least two feed horns of the plurality of feed horns.

2. The multiple beam reflector antenna of claim 1, wherein a substantially flat lower surface of the metamaterial lens is disposed adjacent at least one feed horn aperture of the plurality of feed horns.

3. The multiple beam reflector antenna of claim 1, wherein the metamaterial lens is comprised of one or more of low index materials (LIM), zero index materials (ZIM), and graded index (GRIN) materials having an index of refraction below one or above one.

4. The multiple beam reflector antenna of claim 3, wherein the metamaterial lens has an index of refraction greater than or equal to about zero and less than or equal to about one.

5. The multiple beam reflector antenna of claim 1, wherein a value of electric permittivity $\in$ is substantially equal to a value of magnetic permeability $\mu$ at one of a substantially flat lower surface of the metamaterial lens and a substantially flat top surface of the metamaterial lens.

6. The multiple beam reflector antenna of claim 1, wherein the metamaterial lens has a thickness of less than about one-half of a wavelength of a center frequency of at least one of the plurality of feed horns.

7. A multiple beam reflector antenna, comprising:

at least one reflector, a plurality of feed horns feeding the at least one reflector, each feed horn in the plurality of feed horns terminating in a feed horn aperture; and a metamaterial lens interposed between at least one feed horn aperture of the plurality of feed horns and the at least one reflector, wherein the metamaterial lens provides an overlapping element distribution from at least two feed horns of the plurality of feed horns.

8. The multiple beam reflector antenna of claim 7, wherein a substantially flat lower surface of the metamaterial lens is disposed adjacent the at least one feed horn aperture of the plurality of feed horns.

9. The multiple beam reflector antenna of claim 7, wherein the metamaterial lens is comprised of one or more of low index materials (LIM), zero index materials (ZIM), and graded index (GRIN) materials having an index of refraction below one or above one.

10. The multiple beam reflector antenna of claim 9, wherein a value of electric permittivity $\in$ is substantially equal to a value of magnetic permeability $\mu$ at one of a substantially flat lower surface of the metamaterial lens and a substantially flat top surface of the metamaterial lens.

11. The multiple beam reflector antenna of claim 7, wherein the metamaterial lens has a thickness of about half of a wavelength of a center frequency of at least one of the plurality of feed horns.

12. A multiple beam reflector antenna, comprising:

at least one reflector, a plurality of feed horns feeding the at least one reflector, each feed horn in the plurality of feed horns including a throat section that terminates in a substantially conical section, the substantially conical section flaring outwardly from the throat section and terminating in a feed horn aperture; and a metamaterial lens interposed between at least one feed horn aperture of the plurality of feed horns and the at least one reflector, wherein the metamaterial lens provides an overlapping element distribution from at least two feed horns of the plurality of feed horns.

13. The multiple beam reflector antenna of claim 12, wherein a substantially flat lower surface of the metamaterial lens is disposed adjacent at least one feed horn aperture of the plurality of feed horns.

14. The multiple beam reflector antenna of claim 12, wherein the metamaterial lens is comprised of one or more of low index materials (LIM), zero index materials (ZIM), and graded index (GRIN) materials having an index of refraction above one or below one.

15. The multiple beam reflector antenna of claim 12, wherein the metamaterial lens has an index of refraction greater than or equal to about zero and less than or equal to about one.

* * * * *